US005636496A

United States Patent [19]

Pietiläet al.

[11] Patent Number: 5,636,496

[45] Date of Patent: Jun. 10, 1997

[54] PROCEDURE AND APPARATUS FOR WINDING A WRAPPER AROUND A PIECE OF GOODS, AND PACKAGE

[75] Inventors: Juha Pietilä; Hannu Anttila, both of Masku, Finland

[73] Assignee: Oy M. Haloila AB, Masko, Finland

[21] Appl. No.: 507,909

[22] Filed: Jul. 27, 1995

[30] Foreign Application Priority Data

Aug. 1, 1994 [FI] Finland ..... 943586

[51] Int. Cl.[6] ..... B65B 13/04; B65B 53/00; B65B 53/02

[52] U.S. Cl. ..... 53/399; 53/441; 53/442; 53/556; 53/557; 53/588

[58] Field of Search ..... 53/399, 441, 442, 53/556, 557, 588, 587

[56] References Cited

U.S. PATENT DOCUMENTS

| | | | |
|---|---|---|---|
| 3,640,048 | 2/1972 | Zelnick et al. | 53/557 |
| 3,855,756 | 12/1974 | Sweeney et al. | 53/442 |
| 5,048,261 | 9/1991 | Lancaster et al. | 53/587 X |

FOREIGN PATENT DOCUMENTS

| | | | |
|---|---|---|---|
| 89200853.3 | 4/1989 | European Pat. Off. . | |
| 80418 | 2/1990 | Finland . | |
| 1486014 | 8/1972 | Germany . | |
| 3115911 | 11/1982 | Germany . | |
| 8501270 | 12/1986 | Netherlands | 53/588 |
| 1411318 | 10/1975 | United Kingdom . | |
| 2057386 | 4/1981 | United Kingdom | 53/557 |

*Primary Examiner*—Linda Johnson

*Attorney, Agent, or Firm*—Merchant, Gould, Smith, Edell, Welter & Schmidt, P.A.

[57] ABSTRACT

A procedure for winding a wrapper (1) around a piece of goods (2) includes the steps of pulling a shrinkable film (5) over the upper part of the goods, winding the wrapper around the goods so that the film is partly impacted under the wrapper, and cutting off and seaming the wrapper. The wrapper is unshrinkable relative to the film. Only the film is heated, and it shrinks and becomes tightened around the upper part of the goods. An apparatus includes assembly for pulling a shrinkable film over the upper part of the goods, assembly for winding a relatively unshrinkable wrapper around the goods, assembly for cutting off and seaming the wrapper, and a heating device for heating only the film wherein the heating device is disposed above the film whereby a hot air is blown against the film. The tightened film supports the upper part of the goods so that the goods cannot fan out during transport or delivery.

6 Claims, 3 Drawing Sheets

PROCEDURE AND APPARATUS FOR WINDING A WRAPPER AROUND A PIECE OF GOODS, AND PACKAGE

BACKGROUND OF THE INVENTION

The present invention concerns a procedure for winding a wrapper around a piece of goods.

The invention further concerns apparatus as for winding a wrapper around a piece of goods.

In addition, the invention concerns a package for winding a wrapper around a piece of goods.

In prior art procedures and apparatus are known in which the product or goods conveyed to a wrapping station is enshrouded in a wrapper by winding material from a wrapper roll around the goods, the wrapper being cut off and seamed after the wrapping step.

Furthermore, in prior art wrapping procedures and apparatus are known in which the wrapper roll is kept stationary and the goods to be wrapped is rotated, thus winding wrapper material upon the goods, and the wrapper being ultimately cut off and seamed.

In addition, a procedure and apparatus are known in which in the wrapping machine a top film is spread out upon the upper part of the goods; reference is made to the publicizing print FI-80418. In said reference a procedure and apparatus is disclosed in which the wrapping machine is provided with a top film unit, arranged to spread out a top film over the product which is being packaged and to cut the top film off to desired dimension.

The problem encountered in procedures and apparatus of prior art is that of achieving a package which holds firmly together. When for instance roofing felt rolls standing vertically on a load pallet are enshrouded in a wrapper, the package cannot be made firm enough by any procedure of prior art. Furthermore, when a bag-like shrink film is used, a problem is posed by the shrinking and tightening of this bag in the corners of the package, the rolls positioned in the corners being urged towards the centre of the package and the rolls on the sides tending to b displaced outward. This causes a tendency of the package to fall apart, whereby its handling becomes cumbersome. The package must moreover be handled with care, and this contributes to make its handling a slow job.

SUMMARY OF THE INVENTION

The object of the invention is to eliminate the drawbacks mentioned.

Specifically, the object of the invention is to disclose a novel procedure and apparatus which are appropriate for packaging goods when the completed package is desired to be firm and well tolerant of handling.

It is further an object of the invention to disclose an economical packaging procedure.

It is moreover an object of the invention to disclose a novel type of package which is both firm and sturdy and advantageous to produce.

Regarding the features characterizing the invention, reference is made to the claims section.

The packaging procedure, apparatus and package of the invention are based on the properties of shrink film to be processed by heating. Moreover, the packaging method, packaging apparatus and package of the invention are based on joint use of wrapping material and top film which is meant to be shrunk by heating, whereby a package is obtained which is firm and well-protected, and economically advantageous to produce.

As taught by the invention, a procedure known in itself in the art is used to pull over the goods a top film meant to be shrunk by heating. Wrapper material is thereafter wound by a procedure known in itself in the art around the package in such manner that the margins of the top film are impacted under the wrapper that is being wound. Finally, the top film is heated e.g. by means of a heater blower, whereby the top film is caused to shrink and to tighten around the upper part of the goods.

The invention of the application differs from the state of the art, in particular, in that according to the invention for packaging the goods is used both a wind-on wrapper and a top film meant to be shrunk by heating. Furthermore, the invention enables e.g. roofing felt rolls or equivalent to be packaged so that the completed package will be firm and well-protected. The top film shrunk by heating will tighten uniformly around the goods placed in square configuration, for instance, in such manner that it will become taut and will exert pressure on each side of the square, uniformly over its entire length, whereby the package will be firm and sturdy and tolerate handling without failing apart.

Furthermore, the procedure of the invention differs from those procedures of prior art in which a shrink film bag is pulled over the goods, the goods being completely accommodated in said bag. When shrink plastic is used as taught by the invention, the shrink plastic is only pulled over the top part of the goods, around which it is shrunk by heating. This is because the problem is often expressly that dispersion will take place in the upper part of the package when the package is being handled.

In an advantageous embodiment of the invention, the top film is heated by blowing hot air upon the top film, whereby the top film is caused to shrink and to tighten around the goods.

In another advantageous embodiment of the invention, the apparatus comprises a heatable body for use in heating the top film, this body being brought up close to the top film. The heat will then be transferred to the top film by radiation, and the top film will shrink and be tightened around the goods.

The advantage of the invention is that in the packaging process a top film meant to be shrunk by heating and a wrapper can be used in combination, whereby a firm and sturdy, and well-protected, package is obtained.

It is a further advantage of the invention that there is no need to enshroud the whole package with heat-shrink plastic, which is expensive. Furthermore, less heating energy is consumed by virtue of the invention since there is less of the shrink plastic to be heated.

In addition, thanks to the invention such goods can now be packaged in an advantageous and swift manner the packing of which in a sturdy package has heretofore been expensive and time-consuming.

BRIEF DESCRIPTION OF DRAWINGS

In the following the invention is described in detail, referring to the attached drawing, wherein.

DETAILED DESCRIPTION OF THE PREFERRED EMBODIMENT

Figure 1:
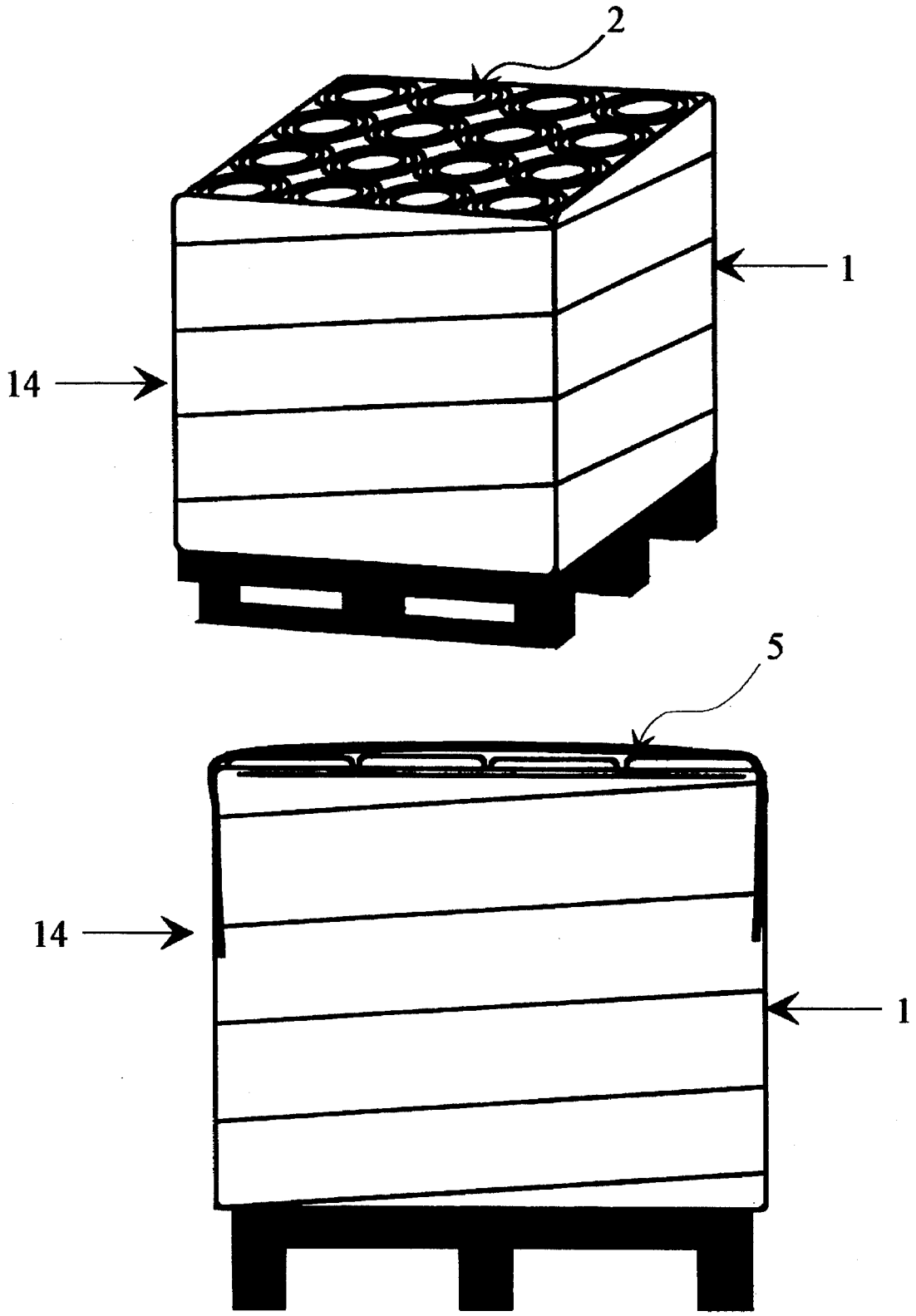
FIG. 1 presents an embodiment of the package of the invention, viewed obliquely from above and from one side.

In FIG. 1 is seen a package 14 formed upon a load pallet in accordance with an embodiment of the invention. As taught by the invention, over the upper part of the goods 2 is pulled a top film 5 meant to be shrunk by heating. The top film advantageously consists of shrink plastic foil. Wrapper material 1 is then wound around the package in such manner that the top film which has been pulled over the upper part of the goods will be partly impacted under the wrapper. Furthermore, the top film is heated, whereby it is caused to shrink and to tighten around the upper part of the goods. The shrunk, and tightened, top film serves as a frame steadying the package in its/upper parts.

Figure 2:
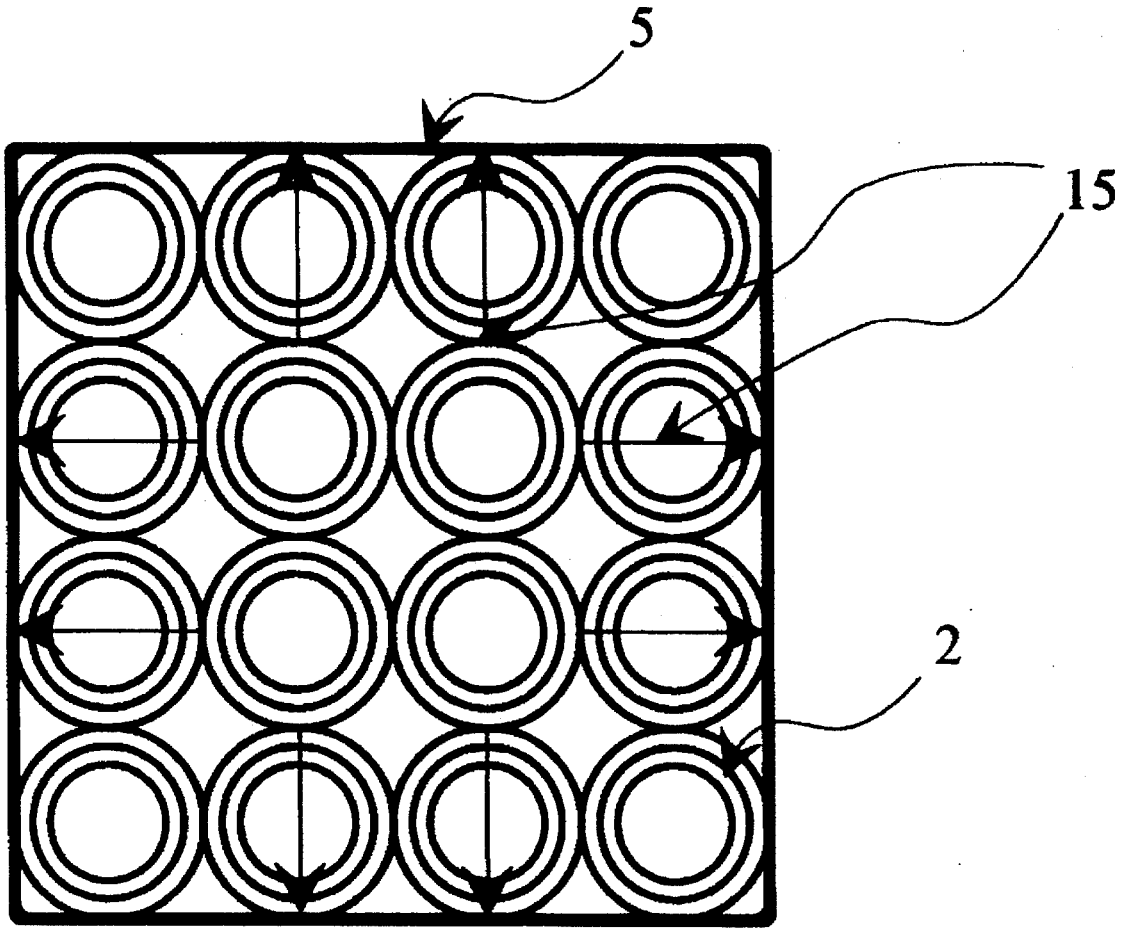
FIG. 2 presents an embodiment of the package of the invention, viewed from above.

In FIG. 2 is depicted the schematic presentation of an embodiment of the package 14 of the invention. Arrows 15 in the figure indicate points of support constituted by the top film 5. The goods to be packaged, 2, e.g. roofing felt rolls, often has the tendency to fan out from the centre when the wrapper 1 is tightly wound around the goods. However, the top film of the invention furnishes support to the goods particularly at the points indicated by arrows so that the goods cannot fall apart e.g. during transport or delivery. The top film consists of heat-shrinkable material.

Figure 3:
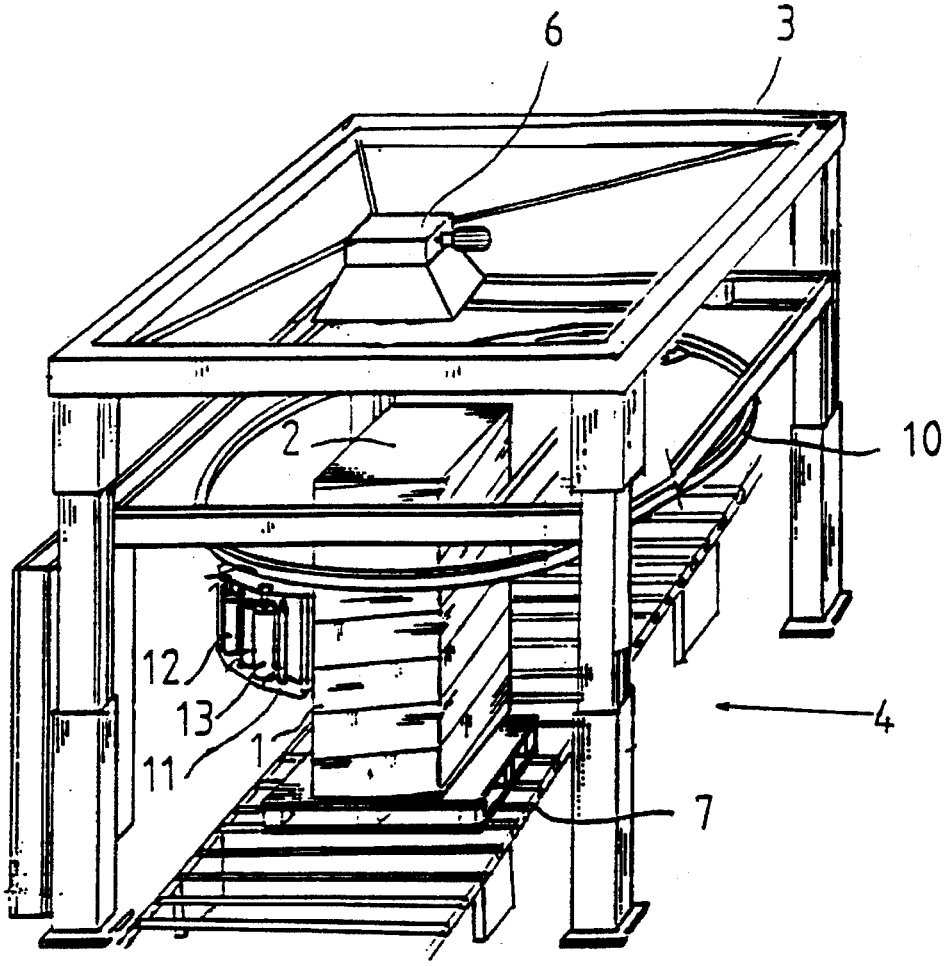
FIG. 3 presents, viewed obliquely from above, a wrapping machine according to the invention, in schematic presentation.

FIG. 3 shows a wrapping machine for winding a wrapper 1 around the goods 2 conveyed to the wrapping station 4. The wrapping machine is a so-called wrapping circle machine in type, featuring a wrapping circle 10 rotating, carried by the frame (the rotatable bearing arrangement of the wrapping circle in support of the frame, and its drive mechanism, have not been depicted in order to make the structure more clearly discernible), this wrapping circle carrying a circularly revolving film distributor carriage 11, the so-called wrapping member, from the wrapping material roll provided thereon the wrapper material being wound around the goods. In FIG. 3, the goods to be packaged, 2, consists of a package upon a load pallet. Further in FIG. 3 is seen the heating device 6 of a wrapping machine according to the invention. The heating device has been disposed above the goods to be packaged, in such manner that it heats the top film pulled over the goods, sufficiently for shrinking the top film. The heating device depicted in FIG. 3 is e.g. a hot air blower by which hot air is blown against the top film.

In an advantageous embodiment of the invention, the heating device is a heatable body disposed to be movable so that it can be moved to one side, out of the way, for the duration of pulling the top film 5 and winding the wrapper 1.

Figure 4:
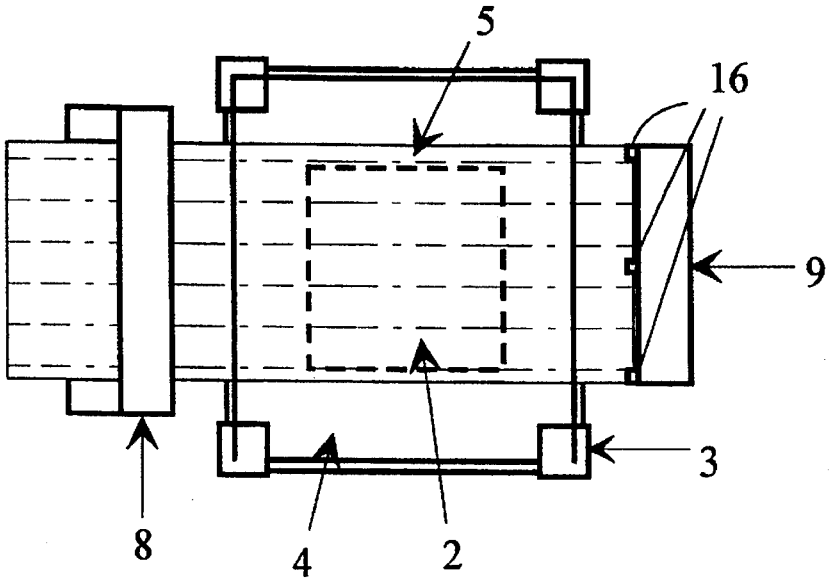
FIG. 4 presents, viewed from above, a top film pulling device according to the invention.

In FIG. 4 are seen the pulling means 8,9 for the top film 5, these means being mounted to be carried by the frame 3 of the wrapping machine. The end of the film strip has been conducted from the top film roll to a film holder 8. The top film puller 9 has been installed to be movable on a parallel pair of rails and provided with grab members 16. The grab members have been arranged to grab the film and to pull it with the aid of screws or equivalent, driven e.g. by electric motors, over the top surface of the goods that is being packaged. The top film 5 is pulled over the goods or package prior to its wrapping. The top film 5 may equally be pulled over the package after the wrapping step. In that case the grab members 16 of the top film pulling device take hold of the film strip end held by the film holder 8 and pull it over the goods. The top film is thereafter cut off and wrapping is continued upon the margins of the top film. Ultimately, the top film is heated with the aid of the heating device.

When the procedure of the invention is applied and the respective apparatus used, the product to be packaged, that is the good which is to be wrapped, is conveyed with the aid of a transport means 7, which may be e.g. a roll conveyor, to the wrapping station 4 of the wrapping machine, FIG. 4, and upon completed wrapping it is transported to storage, for instance.

The wrapping procedure of the invention is appropriate to be used in wrapping apparatus of the type in which the film roll revolves circularly around the stationary goods to be wrapped. The procedure of the invention is further appropriate to be used in the type of wrapping apparatus where the goods to be wrapped is rotated in stationary position, thus/winding the wrapper around the goods. Moreover, the procedure of the invention is appropriate for use in conjunction with the type of wrapping apparatus in which the wrapping material is wrapped around the goods with the aid of a revolving crank arm.

The invention is not exclusively delimited to concern the embodiment examples presented in the foregoing: numerous modifications can be contemplated within the scope of the inventive idea defined by the claims.

We claim:

1. A procedure for winding a wrapper around a piece of goods, comprising the steps of:

conveying the goods to a wrapping station;

pulling a film only over an upper part of the goods, the film being shrinkable;

winding the wrapper around the goods in which the film is partly impacted under the wrapper, the wrapper being unshrinkable relative to the film;

cutting off and seaming the wrapper; and heating only the shrinkable film wherein the film shrinks and becomes tightened around the upper part of the goods so that the wrapper around the goods is tightened, firm, and sturdy.

2. Procedure according to claim 1, further comprising a step of winding a first wrapper prior to pulling over the film, the step of winding the first wrapper and the step of winding the wrapper after pulling over the film starting wrapping from a lower part of the goods, margins of the film overlapping partly with the first wrapper proximate the upper part of goods, and the margins of the film being impacted under the wrapper wound after pulling over the film.

3. Procedure according to claim 1, wherein in the step of heating, the film is heated by means of a heating device, the heating device is disposed above the shrinkable film and heats only the shrinkable film whereby a hot air is blown against the film.

4. An apparatus for winding a wrapper around a piece of goods comprising:

means for pulling a film only over an upper part of the goods, the film being shrinkable;

means for winding the wrapper around the goods, the wrapper being unshrinkable relative to the film;

means for cutting off and seaming the wrapper; and a heating device for heating only the shrinkable film, wherein the shrinkable film shrinks and becomes tightened around the upper part of the goods so that the wrapper around the goods is tightened, firm, and sturdy.

5. An apparatus according claim 4, wherein the heating device is a hot air blower, the heating device is disposed above the shrinkable film and heats only the film whereby a hot air is blown against the film.

6. An apparatus according to claim 4, wherein the heating device is a heatable body which is brought into proximity of the film to be heated so that heat is transferred to the film by radiation.

* * * * *

UNITED STATES PATENT AND TRADEMARK OFFICE
CERTIFICATE OF CORRECTION

PATENT NO. : 5,636,496

DATED : June 10, 1997

INVENTOR(S) : Pietilä et al.

It is certified that error appears in the above-identified patent and that said Letters Patent is hereby corrected as shown below:

On the title page, item [19], "Pietiläet" should read --Pietilä et al -- item [73] Assignee, "Masko" should read --Masku--.

In column 1, line 9, delete "as" after the word "apparatus".

In column 1, line 40, "b" should read --be--.

In column 2, line 60, insert --:-- after the word "wherein".

Signed and Sealed this

Thirty-first Day of March, 1998

Bruce Lehman

*Attest:*

BRUCE LEHMAN

*Attesting Officer*

*Commissioner of Patents and Trademarks*